US011034419B2

(12) United States Patent
Kuder et al.

(10) Patent No.: US 11,034,419 B2
(45) Date of Patent: Jun. 15, 2021

(54) AIRBAG COMPARTMENT ENCLOSURE ASSEMBLY

(71) Applicant: Dakine IP Holdings LP, New York, NY (US)

(72) Inventors: Nathan Kuder, Mt. Hood Parkdale, OR (US); Scott Bryan, Hood River, OR (US); David Trenholm, Hood River, OR (US); Lone Keopaseuth, Hood River, OR (US)

(73) Assignee: Dakine IP Holdings LP, New York, NY (US)

( * ) Notice: Subject to any disclaimer, the term of this patent is extended or adjusted under 35 U.S.C. 154(b) by 0 days.

(21) Appl. No.: 16/153,587

(22) Filed: Oct. 5, 2018

(65) Prior Publication Data

US 2019/0106185 A1 Apr. 11, 2019

Related U.S. Application Data

(60) Provisional application No. 62/568,489, filed on Oct. 5, 2017.

(51) Int. Cl.
*B63C 9/00* (2006.01)
*A62B 99/00* (2009.01)
(Continued)

(52) U.S. Cl.
CPC ..... *B63C 9/00* (2013.01); *A62B 99/00* (2013.01); *A63B 1/00* (2013.01); *A63B 29/02* (2013.01);
(Continued)

(58) Field of Classification Search
CPC .. B63C 9/00; B63C 9/08; B63C 9/081; B63C 9/11; B63C 9/125; B63C 9/18;
(Continued)

(56) References Cited

U.S. PATENT DOCUMENTS 2,423,889 A 7/1947 Hurt
4,421,150 A 12/1983 Masters
(Continued)

FOREIGN PATENT DOCUMENTS

CA 2628182 A1 6/2007
DE 6925683 U 10/1969
(Continued)

OTHER PUBLICATIONS

U.S. Receiving Office of WIPO, International Search Report and Written Opinion of the International Searching Authority regarding PCT Patent Application No. PCT/US2018/054749, dated Dec. 31, 2018, 11 pages.
(Continued)

*Primary Examiner* — Daniel V Venne
(74) *Attorney, Agent, or Firm* — Kolisch Hartwell, P.C.

(57) ABSTRACT

An airbag compartment enclosure assembly is disclosed, including a compartment containing an uninflated airbag and a closure device fixed proximate an opening of the compartment. The closure device has an open position allowing expansion of the airbag through the opening and a closed position retaining the uninflated airbag. The closure device includes a first flap extending from a first edge of the opening and a second flap extending from a second, opposing edge of the opening. The first and second flaps are folded over one another in the closed position.

18 Claims, 4 Drawing Sheets

(51) Int. Cl.
*A63B 1/00* (2006.01)
*A63B 29/02* (2006.01)
*A62B 33/00* (2006.01)

(52) U.S. Cl.
CPC ..... *A62B 33/00* (2013.01); *B63C 2009/0023* (2013.01)

(58) Field of Classification Search
CPC ..... B63C 2009/00; B63C 2009/0023; B63C 2009/007; B63C 2009/0076; A62B 99/00
USPC ..... 441/80, 88, 90, 92–94, 96, 106, 108, 441/111–116, 129
See application file for complete search history.

(56) References Cited

U.S. PATENT DOCUMENTS

| | | | | |
|---|---|---|---|---|
| 4,818,120 | A | 4/1989 | Addiego | |
| 4,840,611 | A | 6/1989 | Van Erden et al. | |
| 6,149,305 | A | 11/2000 | Fier | |
| 6,158,380 | A | 12/2000 | Aschauer et al. | |
| 6,481,183 | B1 | 11/2002 | Schmidt | |
| 6,568,852 | B1 | 5/2003 | Godshaw et al. | |
| 6,678,923 | B2 | 1/2004 | Goldberg et al. | |
| 7,270,077 | B2 | 9/2007 | Beck | |
| 7,878,141 | B2 | 2/2011 | Paynton et al. | |
| 8,123,581 | B2 | 2/2012 | Aschauer | |
| 8,494,480 | B2 * | 7/2013 | Aschauer | A63B 29/021 455/352 |
| 8,777,684 | B2 | 7/2014 | Grutta et al. | |
| 8,851,948 | B2 | 10/2014 | Grutta et al. | |
| 8,851,949 | B2 | 10/2014 | Grutta et al. | |
| 8,876,568 | B2 | 11/2014 | Blenkarn et al. | |
| 9,004,116 | B2 | 4/2015 | Walker et al. | |
| 9,289,633 | B2 | 3/2016 | Walker et al. | |
| 9,427,625 | B2 | 8/2016 | Rose et al. | |
| 9,492,711 | B2 | 11/2016 | Walker et al. | |
| 9,585,425 | B2 * | 3/2017 | Berchten | A62B 33/00 |
| 9,770,626 | B2 * | 9/2017 | Rose | A45F 3/04 |
| 2002/0028029 | A1 | 3/2002 | Revels et al. | |
| 2006/0045390 | A1 | 3/2006 | Sill et al. | |
| 2006/0248632 | A1 | 11/2006 | Colombo | |
| 2006/0261115 | A1 | 11/2006 | Gracer | |
| 2006/0283907 | A1 | 12/2006 | Green et al. | |
| 2009/0020579 | A1 | 1/2009 | Jackson | |
| 2009/0239428 | A1 | 9/2009 | Berchten | |
| 2010/0112880 | A1 * | 5/2010 | Aschauer | A45F 3/04 441/80 |
| 2010/0184343 | A1 | 7/2010 | Paynton et al. | |
| 2010/0255809 | A1 * | 10/2010 | Aschauer | A62B 99/00 455/404.2 |
| 2012/0060267 | A1 | 3/2012 | Blenkarn et al. | |
| 2013/0283510 | A1 * | 10/2013 | Berchten | A62B 33/00 2/455 |
| 2015/0228174 | A1 | 8/2015 | Bauer | |
| 2016/0015094 | A1 | 1/2016 | Walker et al. | |
| 2016/0016043 | A1 * | 1/2016 | Rose | A45F 3/04 441/114 |
| 2016/0016044 | A1 * | 1/2016 | Rose | A45F 4/02 441/114 |
| 2016/0016045 | A1 | 1/2016 | Rose et al. | |

FOREIGN PATENT DOCUMENTS

| | | | |
|---|---|---|---|
| EP | 0957995 | B1 | 12/2001 |
| EP | 2016852 | B1 | 12/2010 |
| WO | 2006064045 | A1 | 6/2006 |

OTHER PUBLICATIONS

The International Bureau of WIPO, International Preliminary Report on Patentability regarding PCT Patent Application No. PCT/US2018/054749, dated Apr. 16, 2020, 7 pages.

* cited by examiner

AIRBAG COMPARTMENT ENCLOSURE ASSEMBLY

CROSS-REFERENCES

This application claims the benefit under 35 U.S.C. § 119(e) of the priority of U.S. Provisional Patent Application Ser. No. 62/568,489, filed Oct. 5, 2017, the entirety of which is hereby incorporated by reference for all purposes.

FIELD

This disclosure generally relates to deployable airbags for use in snow or avalanche safety equipment. Specifically, it relates to closure devices for avalanche airbag assemblies.

INTRODUCTION

Avalanche safety is a major concern for backcountry snow sports enthusiasts. Safety gear that helps a user avoid burial in an avalanche is therefore highly beneficial and potentially life-saving. One type of avalanche safety equipment is an avalanche airbag carried or worn by the user. When deployed, the avalanche airbag inflates rapidly to effectively increase the volume of the user and thus keep the user near the surface of an avalanche slide. Prior to deployment, the airbag is stored in a compartment carried or worn by the user. A design challenge for avalanche airbags is securing the airbag in the compartment during normal activity, while also allowing the airbag to exit the compartment rapidly during deployment. One known closure mechanism relies on hook-and-loop fasteners, but the strength and effectiveness of these fasteners varies when they accumulate moisture or ice/snow and decreases with repeated use. Another existing closure mechanism is a specialty zipper that opens under the pressure of the deployed airbag, but such zippers often sustain damage when the airbag is deployed and are difficult to reassemble after use.

SUMMARY

The present disclosure provides systems, apparatus, and methods relating to airbag assemblies. In some examples, an airbag compartment enclosure assembly may include a compartment containing an uninflated airbag and a closure device fixed proximate an opening of the compartment. The closure device may have an open position allowing expansion of the airbag through the opening and a closed position retaining the uninflated airbag. The closure device may include a first flap extending from a first edge of the opening and a second flap extending from a second, opposing edge of the opening. The first and second flaps may be folded over one another in the closed position.

In some examples, an airbag compartment enclosure assembly may include a compartment having an opening and a closure covering the opening. The closure may include a plurality of stacked folds of material having an overall stiffness, and the overall stiffness of the plurality of stacked folds may be selected such that the closure opens in response to inflation of an airbag contained in the compartment.

In some examples, an airbag carrier assembly may include a pack having a compartment sized to contain a deflated airbag. The pack may be configured to be worn on a back, waist, or otherwise securely connected to a user. The compartment may include an opening and a closure device having an open position permitting inflation of an airbag contained in the compartment through the opening to a space outside the compartment and a closed position covering the opening. The closure device may transition from the closed position to the open position by unfolding a flexible wall portion.

Features, functions, and advantages may be achieved independently in various examples of the present disclosure, or may be combined in yet other examples, further details of which can be seen with reference to the following description and drawings.

DETAILED DESCRIPTION

Various aspects and examples of an airbag compartment enclosure assembly having a closure device, are described below and illustrated in the associated drawings. Unless otherwise specified, an airbag compartment enclosure assembly in accordance with the present teachings, and/or its various components may, but are not required to, contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed examples. The following description of various examples is merely illustrative in nature and is in no way intended to limit the disclosure, its application, or uses. Additionally, the advantages provided by the examples described below are illustrative in nature and not all examples provide the same advantages or the same degree of advantages.

This Detailed Description includes the following sections, which follow immediately below: (1) Overview; (2) Examples, Components, and Alternatives; (3) Advantages, Features, and Benefits; and (4) Conclusion. The Examples, Components, and Alternatives section is further divided into subsections A and B, each of which is labeled accordingly.

Overview

In general, an airbag compartment enclosure assembly may include a compartment configured to contain an uninflated airbag, the compartment having an opening with a closure device. The closure device may be configured to remain in a closed position, covering the opening, until an airbag contained in the compartment is inflated. At which point, the closure device may open to allow the airbag to exit the compartment and inflate completely. The closure device may include one or more flexible wall portions, folded and/or rolled to cover the opening of the compartment.

Figure 1:
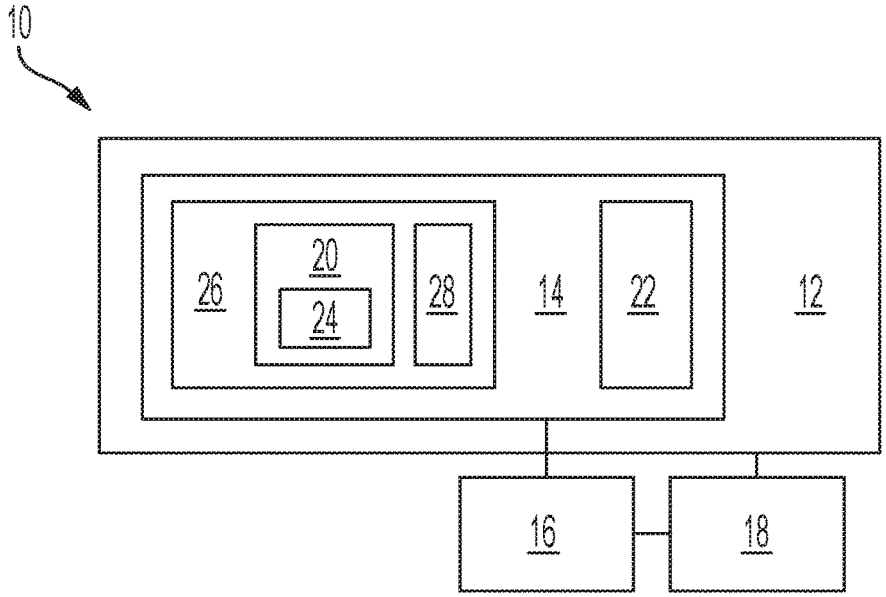
FIG. 1 is a schematic diagram of an illustrative airbag compartment enclosure assembly in accordance with aspects of the present disclosure.

FIG. 1 is a block diagram of an illustrative airbag compartment enclosure assembly 10. The airbag compartment enclosure assembly comprises an airbag 16, an inflation mechanism 18, and a wearable article 12 including a compartment 14. Airbag 16 may be contained in compartment 14 in an uninflated, deflated, or undeployed state. In an inflated or deployed state, airbag 16 may be substantially filled with gas, and the volume of airbag 16 may be larger than the volume of compartment 14. Inflation mechanism 18 may be contained in wearable article 12.

Wearable article 12 may be any garment or pack, including a backpack, belt, wetsuit, vest, or jacket. In reference to article 12, wearable may be understood to mean securely connectable to a user. For example, wearable article 12 may be securely connected to a user with one or more straps, by enclosing some portion of the user, and/or by fastening to a garment.

Airbag compartment enclosure assembly 10 may be configured and/or used to protect a wearer or user in any appropriate situation against any relevant risks. For example, airbag compartment enclosure assembly 10 may be used when skiing, snowboarding, or snowshoeing, to protect against burial in an avalanche. For another example, airbag compartment enclosure assembly 10 may be used to protect a wearer or user against drowning when engaged in recreational activities on a body of water such as sailing, kayaking, or surfing.

Compartment 14 of the airbag compartment enclosure assembly includes one or more flexible wall portions 20. The flexible wall portions may be described as defining an opening 22 in compartment 14, and/or as extending from compartment 14 proximate the opening. Flexible wall portions 20 may also be described as flaps, strips, and/or panels, and may be composed of fabric, plastic, and/or any appropriately flexible material. In some examples, flexible wall portions 20 may be composed of a material matching that of adjacent portions of article 12 and/or compartment 14.

Flexible wall portions 20 may each have a stiffened rim portion 24. In some examples, the stiffened rim portions may be formed by treating edge portions of flexible wall portions 20 with a stiffening agent. In other examples, stiffened rim portions 24 may be formed by embedding strips of plastic, metal, or other material into edge portions of flexible wall portions 20. All flexible wall portions 20 may include a stiffened rim portion, or only some of the flexible wall portions 20 may include a stiffened rim portion. A flexible wall portion may include multiple stiffeners or stiffened portions. The lengths and/or widths of corresponding stiffened portions may be equal.

Flexible wall portions 20 collectively form a closure device 26, which is transitionable between a closed position and an open position. During a transition from the closed position to the open position, closure device 26 may be described as unrolling and/or unfolding. Such a transition may be initiated by inflation of airbag 16 by actuation of inflation mechanism 18, or performed manually by a user of airbag compartment enclosure assembly 10 to gain access to compartment 14 for maintenance or replacement of the airbag. That is, closure device 26 may be openable by two different methods. Closure device 26 may be configured to remain in the closed position unless intentionally opened by a user, or acted on by an inflation of airbag 16.

In the open position, closure device 26 may not cover opening 22 or may only partially cover opening 22. As airbag 16 is inflated, the closure device may allow airbag 16 to at least partially exit compartment 14 through opening 22. Flexible wall portions 20 may not impede inflation of the airbag. The closure device may also allow free-flow of atmospheric air into compartment 14. Flexible wall portions 20 may be described as unfolded and/or flattened and may not contact one other.

When closure device 26 is in the closed position, flexible wall portions 20 may be folded and/or rolled to cover opening 22. Airbag 16, contained in compartment 14, may be prevented from exiting the compartment by the closure device. Flexible wall portions 20 may be described as folded to form a plurality of stacked folds of material. The flexible wall portions may be folded and/or rolled about stiffened rim portions 24. In some examples, flexible wall portions 20 may be folded or rolled at least once, twice, three times, or more, when the closure device is in the closed position.

Rim portions 24 may be aligned with each other when closure device 26 is in the closed position. Corresponding and complementary hook-and-loop alignment pieces may be disposed on each of stiffened rim portions 24 to aid in aligning the rim portions while transitioning closure device 26 to its closed position. Alignment fasteners may additionally or alternatively be disposed on stiffened rim portions 24.

Stiffened rim portions 24 of flexible wall portions 20 may have a curved configuration when closure device 26 is in the closed position. Similarly, the folded flexible wall portions and/or plurality of stacked folds of material may have a curved and/or arched configuration. The curved configuration may be concave relative to compartment 14. In some examples, the curvature may be substantially the same as a curvature of a frame or structural element of article 12. The degree of curvature may be selected to provide a desired level of stiffness and/or resistance to inversion.

Stiffened rim portions 24 may include end portions on opposing sides of a middle portion. The radius of curvature of the middle portion may be greater than the radius of curvature of the end portions. In some examples, the middle portion may be substantially straight. In some examples, the middle portion and the end portions may be substantially straight, and the middle portions may be connected to end portions by curved intermediate portions.

Closure device 26 further includes connectors 28, such as straps, buckles, buttons, and/or clips. The connectors may be configured to hold or restrain the end portions of the folded flexible wall portions when closure device 26 is in the closed position. A connector may be coupled to each end of flexible wall portions 20. Each connector may be further coupled to a side of compartment 14 and/or an adjacent portion of article 12. Each connector may be coupled to an outer surface of the flexible wall portions. In some examples, the connectors may comprise extended end sections of one or more of the flexible wall portions, configured for coupling to article 12. Connectors 28 may facilitate and/or support the curved configuration of stiffened rim portions 24. Such maintenance may be important to retain a selected degree of curvature and to thereby provide the desired level of stiffness, as discussed above. Connectors 28 may be configured to remain connected when closure device 26 opens in response to inflation of airbag 16. Connectors 28 may be manually operable to disconnect and reconnect. Disconnecting may include, for instance, separating fastener portions and/or releasing tension on a retaining strap. Such capability may facilitate opening of closure device 26 by a user of airbag compartment enclosure assembly 10. For example, a user may open the closure device to install airbag 16 in compartment 14. Such capability may also facilitate return of closure device 26 from the open position to the closed position after deployment of airbag 16. This may allow airbag 16 to be returned to compartment 14 after deflation, in preparation for re-deployment.

When a force is exerted on folded or rolled flexible wall portions 20 from within compartment 14, flexible wall portions 20 may begin to unfold and closure device 26 may begin to transition to an open position. The force may be provided by airbag 16 rapidly inflating. As closure device 26 opens, a curvature of stiffened rim portions 24 and/or folded flexible wall portions 20 may invert or flip. Connectors 28 may remain fastened throughout the transition.

In some examples, connectors 28 may be configured to break when closure device 26 transitions from the closed state to the open state. Such connectors may be replaced when preparing for redeployment of the airbag. In some examples, closure device 26 may include a releasable fastener system configured to be actuated substantially simultaneously with inflation mechanism 18. For instance, the releasable fastener system may comprise a single fastener disposed on the middle portion of stiffened rim portions 24 and operatively connected to a manual ripcord actuator. Inclusion of a releasable fastener system may reduce the threshold value of force needed by airbag 16 to unfold folded flexible wall portions 20 and exit compartment 14.

Closure device 26 may be configured to remain closed until the force exerted on flexible wall portions 20 from within compartment 14 achieves a threshold value. Properties of the closure device may be selected individually or in combination to tune the threshold value of force. For example, the stiffness, the size, and the degree of curvature of the stiffened rim portions may each have a relationship to the threshold value of force. For another example, the number of times flexible wall portions 20 are folded and the degree of tightness with which connectors 28 hold the end portions of the folded flexible wall portions may each have a relationship to the threshold value of force. Additionally, such properties may be interrelated. For instance, the degree of the curvature of the stiffened rim portions may be related to the degree of tightness with which connectors 28 hold the end portions of the folded flexible wall portions.

Compartment 14 may also be configured such that closure 26 opens as desired in response to inflation of airbag 16. For example, the interior volume and/or elasticity of compartment 14 may be related to the force exerted by the airbag for a given volume of inflation. Reducing the compartment volume may reduce the time and/or energy required before the threshold value of force is exerted by the airbag. The threshold value of force may be selected based at least in part on limitations on configurations of compartment 14 and properties of airbag 16 and/or inflation mechanism 18.

Examples, Components, and Alternatives

The following sections describe selected aspects of exemplary airbag assemblies as well as related systems and/or methods. The examples in these sections are intended for illustration and should not be interpreted as limiting the entire scope of the present disclosure. Each section may include one or more distinct examples, and/or contextual or related information, function, and/or structure.

A. Illustrative Airbag Compartment Enclosure Assembly

Figure 2:
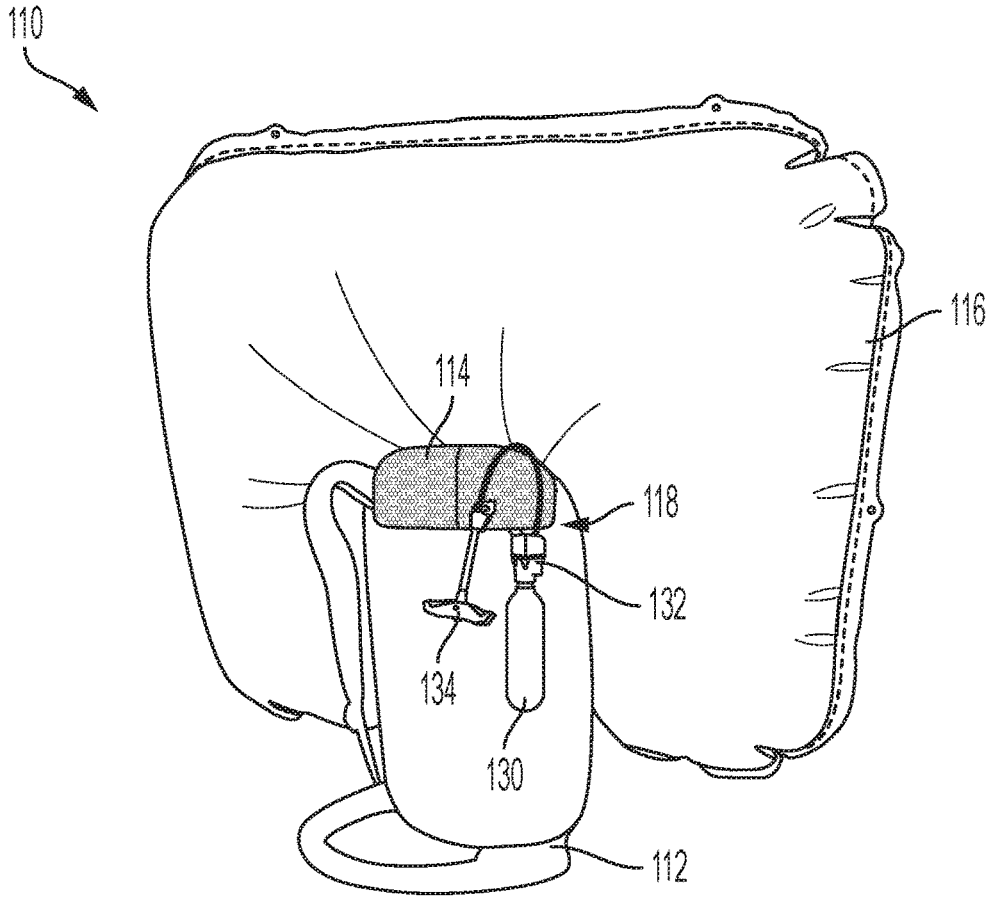
FIG. 2 is a schematic diagram of an illustrative avalanche safety airbag compartment enclosure assembly, with an airbag in an inflated configuration.

As shown in FIGS. 2-8, this section describes an illustrative avalanche safety airbag compartment enclosure assembly, generally indicated at 110. Enclosure assembly 110 is an example of airbag compartment enclosure assembly 10, described above. As shown in FIG. 2, enclosure assembly 110 includes an upper compartment 114 of a backpack 112. An airbag 116 is shown inflated, with a central region anchored in compartment 114, as the airbag would be during use. Airbag 116 is also configured to be entirely contained in the compartment, when deflated and not currently in use. An inflation mechanism 118 is housed in backpack 112 and coupled to airbag 116.

Assembly 110 may be designed and/or modified for use with any effective inflation mechanism 118, including mechanisms relying on compressed gas, atmospheric air, and/or a combination thereof. In the present example, the assembly is shown with a Venturi mechanism, including a cartridge of compressed gas 130, a Venturi valve device 132, and a manual actuator handle 134. Cartridge 130 may be replaceable or refillable for repeated use, and is carried in backpack 112 separate from compartment 114. Venturi valve device 132 connects cartridge 130 to airbag 116, extending through a lower aperture in compartment 114. Manual actuator handle 134 may be disposed in a shoulder strap of backpack 112, or some other portion of the backpack that is accessible to a user while wearing the backpack. Pulling sharply on the handle activates Venturi valve device 132.

During typical use of backpack 112, airbag 116 may be folded and stowed in compartment 114. The airbag may remain stowed until deployment is desired, for instance in the event of an avalanche. At such time, a user or wearer of the backpack may use manual actuator handle 134 to activate Venturi valve device 132, which releases compressed gas from cartridge 130 to begin inflating stowed airbag 116.

Figure 4:
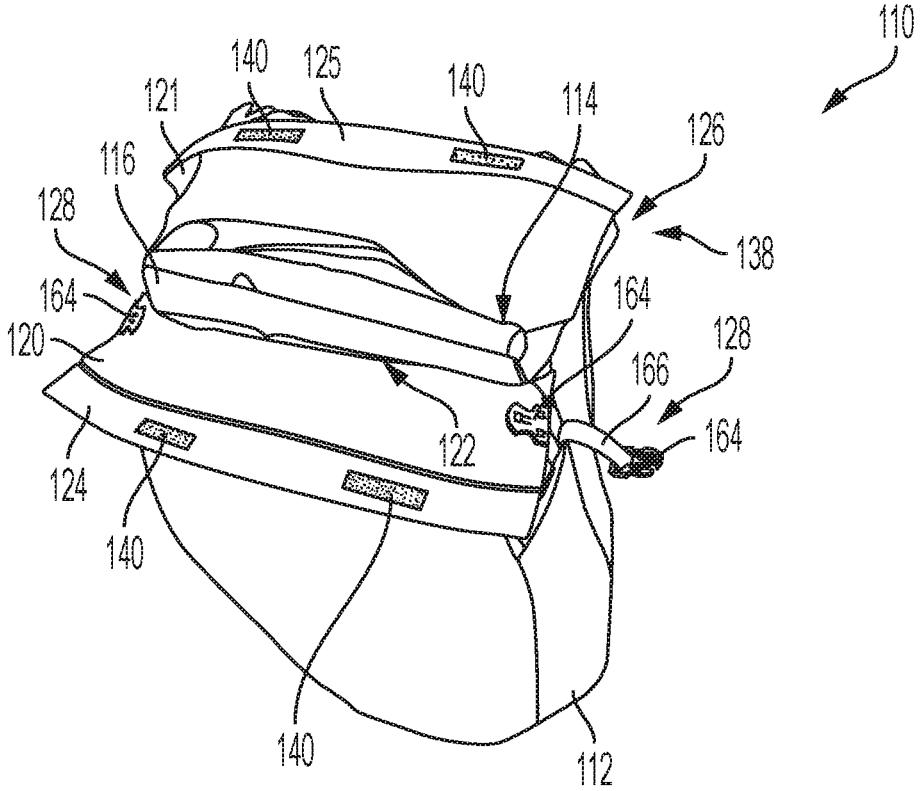
FIG. 4 is an isometric top view of the airbag compartment enclosure assembly of FIG. 3, in an open configuration, with an uninflated airbag.

As shown in FIG. 4, compartment 114 includes a top opening 122. As airbag 116 is inflated, the airbag may expand out through opening 122 to the fully inflated configuration shown in FIG. 2. Airbag 116 may be disposed partially or fully outside of compartment 114 when inflated, and may have any desired shape or configuration. Opening 122 also allows Venturi valve device 132 to draw in atmospheric air to supplement the compressed gas of cartridge 130 for inflation of airbag 116. In some examples, atmospheric air may be supplied through an alternate intake and/or air may be drawn by another method such as with a battery powered fan. When avalanche danger is past, a user may deflate airbag 116 and re-stow the airbag in compartment 114 for re-deployment.

Figure 3:
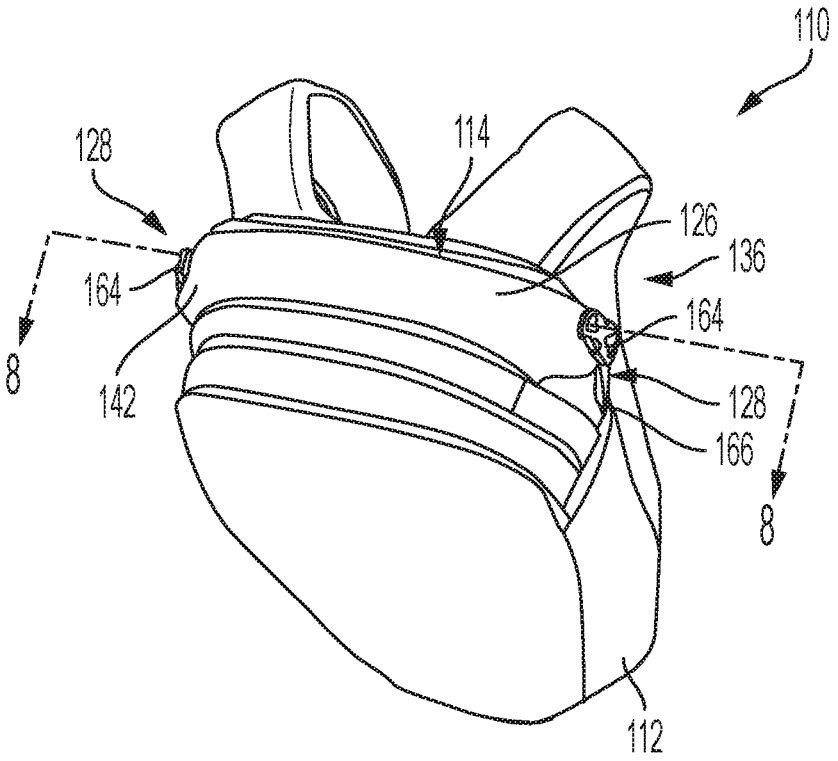
FIG. 3 is an isometric top view of the airbag compartment enclosure assembly of FIG. 2, in a closed configuration.

Compartment 114 also includes a closure 126, shown in FIGS. 3-4, which encloses, contains, and protects airbag 116 while the airbag is stowed and opens as the airbag inflates. Closure 126 has a closed configuration or position 136, shown in FIG. 3, and an open configuration or position 138, shown in FIG. 4. The closure is configured to remain in the closed position throughout normal use of backpack 112. Such use may include lifting backpack 112 by a handle mounted proximate closure 126, or by grasping any convenient portion of material of the backpack, including the closure itself. Such use may include rough handling during transportation, and exposure to strong winds when worn during high-speed skiing. Closure 126 may therefore be strong, secure, and/or tightly closed in closed position 136.

Closure 126 is also configured to transition from closed position 136 to open position 138 in response to inflation of airbag 116. Referring again to FIG. 2, Venturi valve device 132 may be activated when the closure is in the closed position. Compressed gas from cartridge 130 may begin to inflate airbag 116, which may in turn exert pressure on the interior of compartment 114 and on the inside of the closure. The closure is configured to transition rapidly to the open position once the pressure exerted by the airbag, or total force on the closure, surpass a selected threshold.

Enclosure assembly 110 may be used in high-risk scenarios, where failure of airbag 116 to deploy correctly may have drastic consequences. Consistency and reliability are therefore important features of closure 126. For example, in some situations, the closure may need to open reliably despite saturation with melted snow, or accumulation of ice. For another example, if too great a force is necessary to open the closure, a large quantity of compressed gas from cartridge 130 may be expended to inflate airbag 116 before the closure opens and Venturi valve device 132 begins to draw atmospheric air into the airbag. As a result, insufficient compressed gas may remain in cartridge 130 to fully inflate the airbag.

In FIG. 4, backpack 112 is shown with closure 126 in open position 138, and with airbag 116 uninflated, folded, and stowed in compartment 114. For clarity, a side of backpack 112 to which shoulder straps are fixed and which is proximal to a wearer when the backpack is worn, may be referred to as a back side. An opposing side of backpack 112 which is distal to the wearer may be referred to a front side. Similarly, an upper end, lower end, left side, and right side of the backpack may be determined relative to an orientation of the backpack when worn. The terms back, front, upper, lower, left, and right may also be used to describe directions in the context of the backpack, and may be similarly understood even when the backpack is not worn.

Compartment 114 is located at the upper end of backpack 112, proximate the back side of the backpack. In the present example, top opening 122 arches from a left end of the compartment to a right end of the compartment. A curved back edge of the opening is defined by a frame of backpack 112. The dimensions and/or shape of opening 122 may depend on dimensions of airbag 116, and/or design of backpack 112. Adequate space for rapid expansion of airbag 116 may be a key consideration.

Closure 126 includes a front panel (first panel) 120 and a back panel second panel) 121 fixed to compartment 114, along top opening 122. A proximal edge of back panel 121 is fixed along the curved back edge of top opening 122. A proximal edge of front panel 120 is similarly fixed along a curved front edge of top opening 122. Compartment 114 is also fixed to backpack 112 along the front back edges of top opening 122. The panels and compartment may be sewn together, unitary, and/or connected in any sufficiently strong manner.

Front panel 120 and back panel 121 are flexible and can be folded and/or rolled. In the present example, the panels are composed of a nylon fabric and lining that is also used to form a majority of the exterior of backpack 112. Any sufficiently durable and flexible material and/or materials may be used, which may be selected based on a desired stiffness or other properties. The material of the front and back panels may be the same or different, and may be selected to achieve a desired strength or stiffness of closure 126.

Each of the front and back panels has three free edges, including a distal edge. At the distal edge, each panel includes a stiffened rim. Front panel 120 includes a stiffened rim 124 and back panel 121 includes a stiffened rim 125. The stiffened rims 124, 125 may each comprise a strip of material sewn into a folded hem of the panel, as described in further detail in reference to FIG. 5, below. The rims may also be stiffened by bonding a stiffening strip to the panel or treating a portion of the panel with a stiffening agent. Stiffened rims 124 and 125 may be of matching shape and dimension.

Each stiffened rim 124, 125 includes alignment fasteners 140. In the present example, the alignment fasteners include two strips of hook and loop material. That is, rim 124 of front panel 120 includes two strips of hook material and rim 125 of back panel 121 includes two correspondingly disposed strips of loop material. When fastened, alignment fasteners 140 may hold stiffened rim 124 in alignment with stiffened rim 125, in order to facilitate accurate folding of the front and back panels.

Hook and loop fasteners may be susceptible to changes in closure strength due to repeated use, weather conditions, and/or buildup of debris such as dirt or snow. Alignment fasteners 140 may be located inside the folds of closure 126 in the closed position, as described further below. Such location may protect alignment fasteners 140 from the influence of weather or debris. To help prevent any change in the strength of alignment fasteners 140, due to repeated use, from influencing an overall closure strength of closure 126, the alignment fasteners may be selected to have a minimal or limited closure strength relative to other factors determining the overall closure strength of closure 126. That is, alignment fasteners 140 may be just strong enough to facilitate alignment, without changing the strength of closure 126.

Closure 126 further includes a pair of end straps 128, with one strap disposed at each of a left and a right end of the closure. In the present example, each end strap includes a snap-fit buckle and a fixed-length section of nylon webbing. A female portion of each snap-fit buckle is fixed to front panel 120 proximate to the proximal edge and a left or right edge of the panel. Each length of webbing is connected to the male portion of one of the snap-fit buckles at a first end and fixed to backpack 112 at a second end. Any combination of straps and/or fasteners appropriate to achieve equivalent function may be used, as described further in reference to FIG. 7 below.

In open position 138, as shown, front panel 120 and back panel 121 extend laterally away from opening 122. Front panel 120 extends forward, and back panel 121 extends back. Front panel 120 and back panel 121 are not directly connected, and may be described as coupled only through the connection of each panel to compartment 114. Alignment fasteners 140 are unfastened. End straps 128 may or may not be fastened, depending on the method by which closure 126 was opened, as described in further detail with reference to FIG. 7, below.

In open position 138, top opening 122 is uncovered, allowing clearance for airbag 116 to expand through the opening. This configuration also allows for effective airflow into compartment 114 and the Venturi valve device. Front panel 120 and back panel 121 provide a wide mouth for closure 126, which may facilitate a rapid transition from the closed position to the open position in response to inflation of airbag 116.

In FIG. 4, backpack 112 is depicted as unworn. When worn, open position 138 may be somewhat modified by the wearer. For example, back panel 121 may rest against the neck and/or shoulders of the wearer and the back panel may extend more vertically than laterally. The flexible material of back panel 121 may also allow back panel 121 to fold or crumple up. In either configuration, top opening 122 may be uncovered, and ample clearance for airbag 116 allowed.

Figure 5:
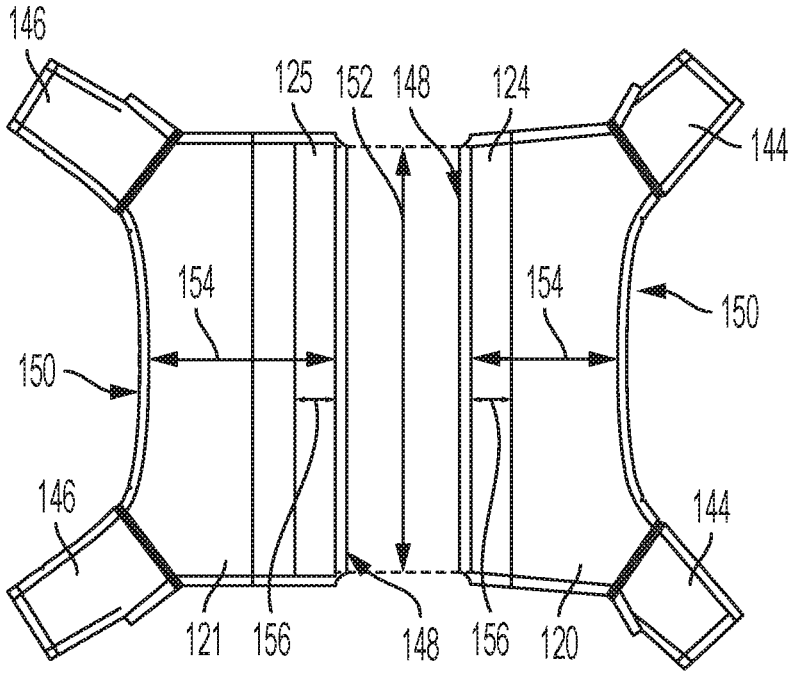
FIG. 5 is a sewing pattern for the front and back panels of the closure of the airbag compartment enclosure assembly of FIG. 3.

To transition closure 126 from open position 138 to closed position 136, as shown in FIG. 5, a user may begin by ensuring that end straps 128 are unfastened. The user may then lift front panel 120 and back panel 121 and bring stiffened rims 124 and 125 into contact, aligning the stiffened rims and engaging alignment fasteners 140. The user may fold the stiffened rims over toward the back of backpack 112, repeating the fold three times in total. With each fold, or roll, material of front panel 120 and back panel 121 may be gathered to form a plurality of stacked folds of material. Stiffened rims 124 may act as a guide for correct size and placement for each fold. Once folded, the user may fasten each end of closure 126 with the corresponding end strap 128.

Such folding may be familiar to a user as similar to simple roll-top closures on bags or backpacks, allowing easy use without need for instruction in correct operation. Unlike simple roll-top closures, closure 126 may be configured to fold tightly and exactly the pre-selected number of times. Stiffened rims 124, 125 may guide the user as to the correct folds, such that closure 126 is correctly placed in closed position 136 and appropriately configured for subsequent airbag deployment. Accurate placement and tightness of folds may be important for tuning of closure 126, and therefore important for correct airbag deployment.

As shown in FIG. 5, in closed position 136, front panel 120 and back panel 121 are folded tight against compartment 114 and backpack 112, over top opening 122. The folded front and back panels are generally indicated at 142, and may also be described as stacked folds, and/or a roll of material. Folded panels 142 conform to the arch of top opening 122, and are tight against the frame of the backpack along the back edge of the opening.

Folded panels 142 are fastened at a left end and a right end by end straps 128. The end straps may be described as holding, restraining, or compressing the ends of the folded panels. End straps 128 may keep folded panels 142 tightly folded. End straps 128 may help to maintain the curved or arched configuration of the folded panels, conforming the ends of the folded panels against the sides of compartment 114 and backpack 112. End straps 128 may facilitate maintenance of closed position 136 during normal use of backpack 112.

A user may open closure 126 from closed position 136 to open position 138 in two different ways. The user may manually open the closure. For instance, the closure may be opened in order to make regular checks on the status of the enclosed airbag and/or to perform maintenance. To manually open closure 126, the user may first unfasten end straps 128. The user may then unfold folded panels 142, release alignment fasteners 140, and separate front panel 120 from back panel 121. The user may also open the closure by triggering inflation of the enclosed airbag. For instance, the user may pull the manual actuator handle. Closure 126 may then be opened by the force and/or pressure exerted by inflation of the enclosed airbag, as described above and in reference to FIG. 8 below.

Figure 6:
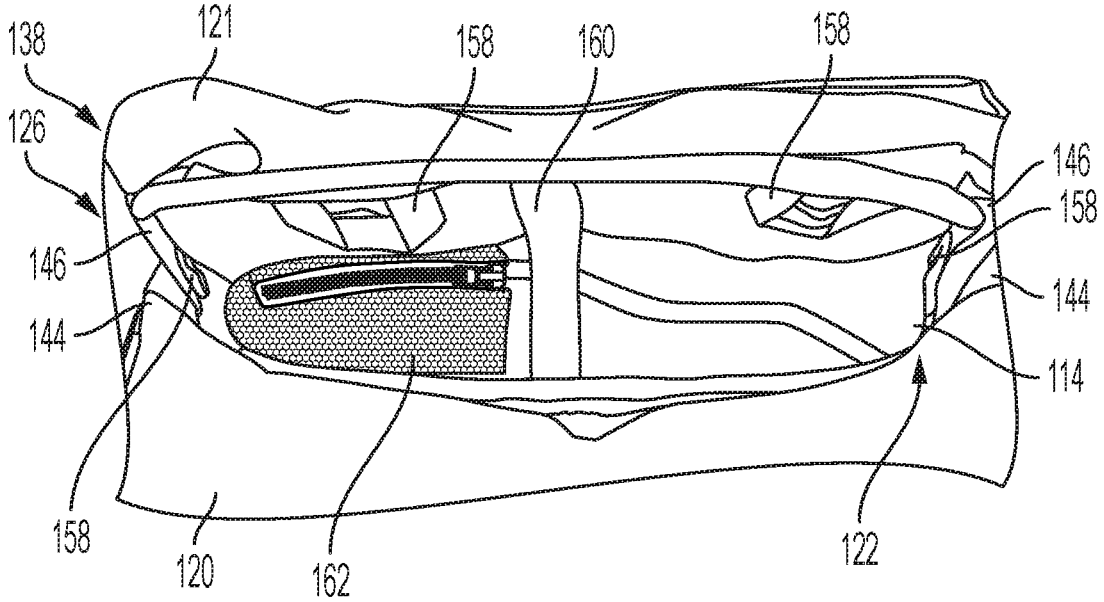
FIG. 6 is a detail top view of the interior of the airbag compartment of the airbag compartment enclosure assembly of FIG. 3.
Figure 7:
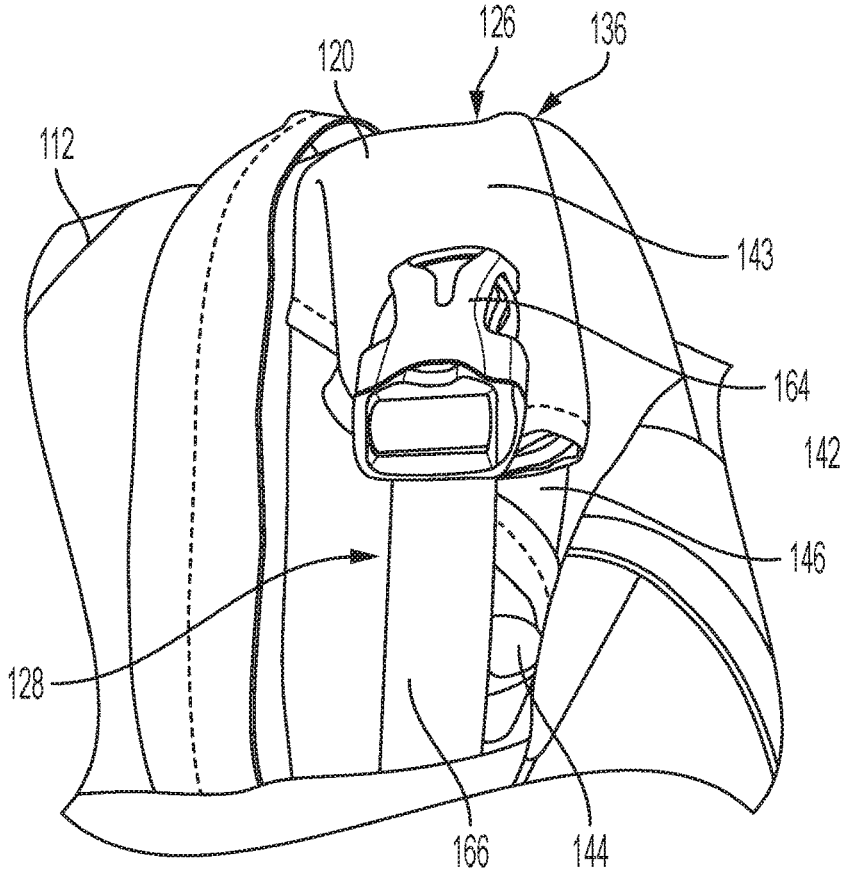
FIG. 7 is a right side view of the closure of the airbag compartment enclosure assembly of FIG. 3.
Figure 8:
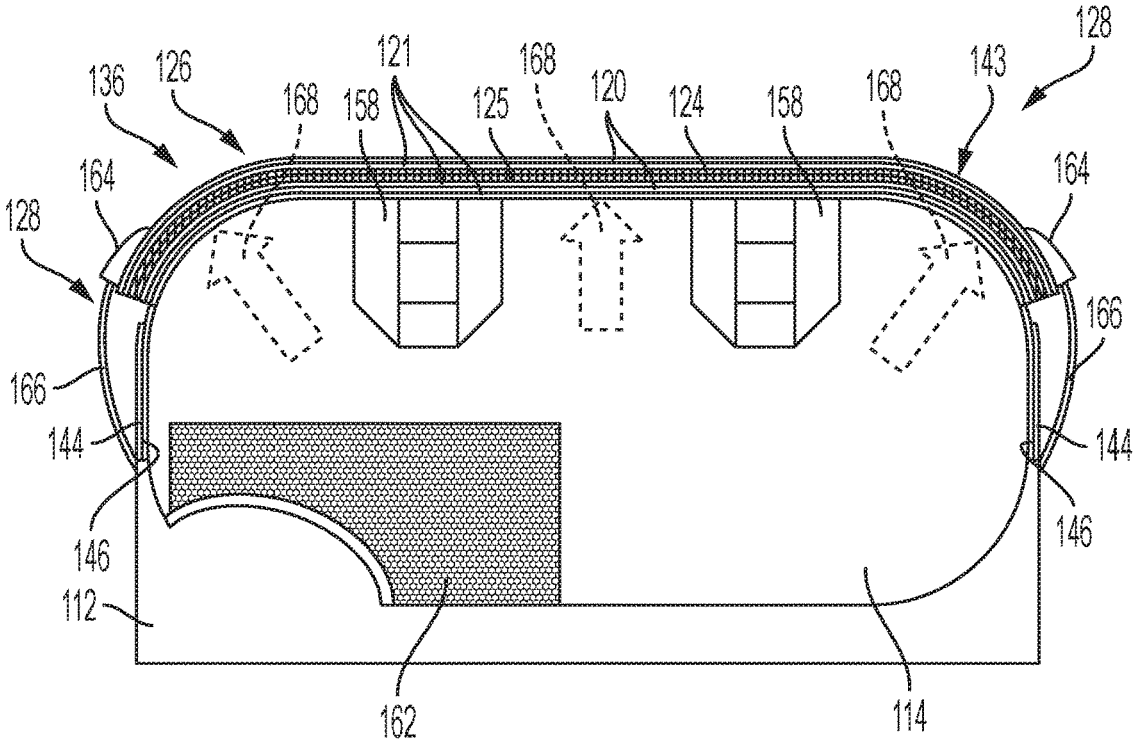
FIG. 8 is a schematic diagram of a cross-section of the airbag compartment of the airbag compartment enclosure assembly of FIG. 3, along line 8-8.

FIG. 5 is a sewing pattern for front panel 120 and back panel 121. Each panel includes two side panels, configured to cover left and right side portions of the top opening. Front panel 120 includes left and right outer side panels 144, and back panel 121 includes left and right inner side panels 146. As can be seen in FIGS. 6-8, when closure 126 is assembled on compartment 114, two side panels overlap at each of the left and right side portions of the top opening. At each side, an inner side panel 146 is interior and an outer side panel 144 is exterior. Side panels 144, 146 allow closure 126 to cover the full arched shape of top opening 122, while front panel 120 and back panel 121 remain primarily rectangular in shape to facilitate simple folding.

Each side panel is fixed to the compartment along a bottom edge and one side edge. Outer side panels 144 are fixed along a front edge, and inner side panels are fixed along a back edge. When closure 126 is in closed position 136, each outer side panel 144 and corresponding inner side panel 146 are fully overlapped. When the closure is in open position 138, each side panel folds away and corresponding panels only partially overlap. Outer side panels 144 fold forward and inner side panels 146 fold backward.

In closed position 136, overlapped side panels 144, 146 may protect the enclosed airbag, helping to insulate it from adverse exterior conditions and debris. In open position 138, the overlapped side panels may help closure 126 to open wide by folding out of the way, and avoid impingement of top opening 122. In some examples, the side panels may be differently shaped, differently assembled, and/or omitted, depending on the shape of the top opening.

Referring again to FIG. 5, some relevant dimensions of front panel 120 and back panel 121 are indicated, each neglecting the depicted seam allowances. Also, a distal edge of each panel is indicated at 148, and a proximal edge of each panel is indicated at 150. Front panel 120 and back panel 121 have a matching width 152 along distal edges 148. In the depicted example, between distal edge 148 and proximal edge 150, each panel has a differing length 154. In some examples, the front and back panels may have similar or equal lengths.

Stiffened rims 124 extend approximately the full width 152 on both front panel 120 and back panel 121. Both stiffened rims have a matching length 156. In order to achieve a tight, repeatable set of folds in the closed position, each panel length 154 may be approximately a multiple of rim length 156. The panel length may be sufficiently more than a multiple to accommodate the turn radius associated with each fold. The number of folds may be selected to achieve a desired strength and/or stiffness of the closure.

If the desired number of folds for the closure is N, one of the two panels may have a length 154 approximately N times rim length 156 and the other panel may have a length approximately N+1 times the rim length. Which panel has the greater length 154 may be determined according to whether the closure is folded forward or backward. In the present example, rim length 156 is approximately 1.25 inches, length 154 of front panel 120 is approximately 4 inches, and length 154 of back panel 121 is approximately 5.5 inches. The closure is configured to fold three times, toward the back of the backpack.

In the present example, each stiffened rim 124 includes a strip of polyethylene plastic board that is 14 inches wide by 1.25 inches long by 1 millimeter thick. The two strips may be identical. Polyethylene is a good stiffener, as it is lightweight, tough, and resilient while retaining very similar dynamic properties for a wide temperature range. At such dimensions, the material provides a limited resistance to bending along its width and a high resistance to bending along its length. This allows stiffened rims 124 to curve along the top opening, while providing a clear guide for correct folds of front and back panels 120,121. The resistance of the polyethylene does not change significantly in sub-zero temperatures or other such environments, allowing the closure to perform consistently across those environments.

Strength of the closure may be tuned by varying the properties of stiffened rims 124. For instance, spring steel may be substituted to increase the strength, or a thinner polyethylene board may be used to decrease the strength. Any stiffening, stiffeners, or combination thereof providing the desired response to bending along length and width may be used, including materials sewn to or into the front and back panels, materials bonded to the panels, quilting, and/or treatment with a stiffening agent.

FIG. 6 shows the interior of compartment 114, through top opening 122, with closure 126 in open position 138. The compartment is limited in size, and may fully accommodate the airbag without additional space. In the present example, compartment 114 has a volume of approximately 2 liters. Compartment 114 is generally rectangular in shape, with rounded corners. Top opening 122 extends across the top of the compartment, arching down to approximately half the depth of the compartment on each of the left and right sides.

Against a back wall of compartment 114 are two anchor points 158. An additional two anchor points are disposed at the left and right sides of the compartment. Anchor points 158 are configured for connection of the airbag, to keep the airbag attached to backpack 112 through the inflation process and while the airbag is in use. As such, each anchor point, the connection of the anchor point to compartment 114, and the connection of compartment 114 to backpack 112 may be sufficiently strong to resist forces applied by inflation and a subsequent lift through avalanche debris. In the present example, each anchor point is a ring of folded nylon webbing sewn into an edge seam of compartment 114, and reinforced with additional stitching. The airbag connects to the anchor points with metal snaps that fasten through the central opening of the ring.

Any effective method of connecting the airbag to backpack 112 may be used. In the present example, the airbag is removable. In some examples the airbag may be permanently fixed to the backpack. For instance, a seam, a tab, or other portion of the airbag may be sewn into compartment 114.

Changes in the volume of compartment 114 may be undesirable. For instance, use of materials with significant elasticity may allow the compartment to expand under pressure. Alterations in volume may in turn alter the force exerted on closure 126 by the airbag from inflation by a given volume. In the present example, compartment 114 includes two perpendicular strips of reinforcing material 160. The strips extend centrally across the compartment, and are configured to provide additional structural strength and reduce elasticity of the compartment.

Compartment 114 may be formed of any appropriate material or materials, and may be located anywhere on backpack 112 that deployment of the airbag is desired. The compartment may include additional features or properties configured to facilitate a particular airbag design and/or inflation mechanism. For example, compartment 114 may include two or more separate sub-compartments housing multiple airbags configured to deploy simultaneously.

In the present example, the airbag is inflated using a Venturi valve device, as described above. Essentially, compressed gas is used to form a siphon that draws in atmospheric air to fill the airbag. Accordingly, good airflow to the valve device is desirable. On the other hand, debris entering the valve device and/or or the airbag with the air may be undesirable. For example, in an avalanche event snow-laden air may adversely affect the valve device. Accordingly, compartment 114 is made primarily of a mesh material, which both allows air flow and serves as a filter for the valve device. Air may be drawn in through the walls of the compartment, while snow, sand, dust, and other debris are filtered out.

In the present example, compartment 114 also includes a mesh sleeve or pocket 162, fixed over an aperture in the bottom of the compartment. The pocket is configured to receive an upper portion of the venturi valve device, with a lower portion of the valve device extending down through the aperture to connect to the compressed gas cartridge. Pocket 162 includes a zipper, allowing a user easy access to a release valve on the Venturi valve device, for deflation of the airbag.

FIG. 7 shows the right end of closure 126, including end strap 128. The closure is depicted in closed position 136, with folded panels 142 covering the top opening and fastened end strap 128 holding the right end of the folded panels against backpack 112. The left end of the closure and left end strap 128 may be understood to be matching, and similarly configured. In the present example, end strap 128 includes a snap fit buckle 164 and a length of webbing 166.

Buckle 164 is of a commonly used style, typically allowing adjustment of the length of a strap threaded through a male portion of the buckle. However, in the present application, the length of end strap 128 is not adjustable. A first end of webbing 166 is sewn into a seam of backpack 112. A second end of webbing 166 is threaded or looped through buckle 164, and also sewn into the seam of backpack 112, fixing the length of end strap 128. In some examples, the second end may be doubled back and sewn onto the webbing, or fixed to buckle 164. Each time end strap 128 is fastened, folded panels 142 may therefore be held with the same strength and/or tightness against backpack 112. As a result, the strength and/or tightness of closure 126 may be consistent and repeatable.

The fixed length of end strap 128 may be selected in order to achieve a desired strength and/or tightness of closure 126. Selecting the length of end strap 128 during design and testing of backpack 112 may provide a simple, low-cost way to tune closure 126 to a desired pressure and/or force threshold. Fixing the length of end strap 128 may prevent accidental, unintended, and/or untrained changes to the strength of closure 126 by a user of backpack 112.

End strap 128 may be configured to hold the end of folded panels 142 tightly, while still allowing a twist in webbing 166. As can be seen in FIG. 4, in open position 138 the female portion of buckle 164 is inverted. When end strap 128 remains fastened in the open position, webbing 166 may need to twist in order to permit the inversion of fastened buckle 164. That is, when closure 126 opens in response to an inflation of airbag 116, end straps 128 may remain fastened and webbing 166 may twist to open position 138.

Referring again to FIG. 7, end straps 128 may be described as connecting an exterior or outer surface 143 of folded panels 142 to backpack 112. The outer surface may also be described as a last fold of folded panels 142. Buckle 164 is approximately centered on outer surface 143, at the end of folded panels 142. The buckle may also be disposed toward a laterally outer edge of the last fold. End straps 128 may thereby secure a full lateral extend of the end of the folded panels against backpack 112.

Any effective end straps and/or fasteners may be used to hold the left and right ends of folded panels 142. Fasteners that are operable at a wide range of temperatures, such as the depicted buckles, may be desirable. The end/straps and or fasteners may be able to withstand repeated fastening and unfastening without significant change in fastening strength. The end straps and/or fasteners may hold folded panels 142 in an arched position, but may twist, turn, rotate or otherwise permit inversion of the folded panels as part of a transition to the open position when a selected pressure and/or force threshold is reached inside the compartment. The end straps may also be releasable by a user, allowing folded panels 142 to be unfolded to manually open the closure.

FIG. 8 is a schematic diagram of a cross-section of compartment 114, as taken along line 8-8 in FIG. 3, with closure 126 in closed position 136. The plurality of stacked folds of material of folded panels 142 can be more clearly seen, with a proximal portion of back panel 121 immediately covering top opening 122. Stiffened rims 124, 125 are toward the middle of the stack, and a proximal portion of front panel 120 is outermost.

Also depicted in FIG. 8 is a force 168 on the closure, due to internal pressure resulting from inflation of the airbag. The force acts from inside compartment 114, on an innermost layer of folded panels 142. As the airbag inflates and increases in pressure, force 168 also increases. Closure 126 is tuned such that when force 168 reaches a selected threshold value, the closure will transition rapidly to the open position.

When force 168 (internal pressure) reaches the threshold value, folded panels 142 may flip up, or invert in curvature. Webbing 166 of end straps 128 may twist, without breaking or releasing buckles 164. Folded panels 142 may further unfold as the airbag continues to inflate and force 168 continues to act on the inside of closure 126. The alignment fasteners may release, and front panel 120 and back panel 121 may be separated from one another, into the open position. The airbag may then complete inflation unimpeded.

As described above, the consequences of a mis-deployment of the airbag, or failure to deploy may be serious and potentially life threatening when backpack 112 is used for avalanche safety. If closure 126 opens too easily, the airbag may become subject to snow, ice, sharp edges, and/or other sources of potential damage prior to deployment. If closure 126 is too difficult to open, too much of the energy stored for the inflation mechanism as compressed gas or battery power may be wasted before the airbag is able to exit compartment 114. Therefore, precise tuning of closure 126 may be important.

Multiple properties of closure 126 may be selected and/or modified to tune the closure to a selected threshold value of force 168. These properties include, but are not limited to: the degree of curvature of folded panels 142 and/or stiffened rims 124, 125; the stiffness or flexibility of the material of stiffened rims and/or front and back panels 120, 121; the number of layers and/or folds of folded panels 142; and the tightness of end straps 128, which may also be described as the length of end straps 128 relative to the distance between the first end of the strap and the adjacent left or right end of the folded panels.

Closure 126 may be configured to be effectively binary in nature. That is, the closure may open sufficiently rapidly, when the threshold value is reached, that the time spent in transition is negligible. For instance, closure 126 may be configured to open in less than 1 second, or less than ½ second. The closed position and open position may be described as clearly distinct, and the closure may be configured to transition completely to the open position every time the airbag is inflated.

B. Illustrative Combinations and Additional Examples

This section describes additional aspects and features of airbag assemblies, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A. An airbag compartment enclosure assembly, comprising:

a compartment containing an uninflated airbag; and a closure device fixed proximate an opening of the compartment, the closure device having an open position allowing expansion of the airbag through the opening and a closed position retaining the uninflated airbag, the closure device including:

a first flap extending from a first edge of the opening, and a second flap extending from a second, opposing edge of the opening;

wherein the first and second flaps are folded over one another in the closed position.

A1. The enclosure assembly of A, wherein the closure device is configured to unfold from the closed position to the open position in response to an increase of pressure inside the compartment.

A2. The enclosure assembly of either A or A1, wherein the closure device is tuned to unfold only when the pressure exceeds a selected threshold.

A3. The enclosure assembly of any of A to A2, further comprising;

an inner side panel fixed at each of two opposing ends of the opening; and an outer side panel overlapping each inner side panel;

wherein the inner side panels are fixed to the second flap, and the outer side panels are fixed to the first flap.

A4. The enclosure assembly of any of A to A3, further comprising a backpack including the compartment.

A5. The enclosure assembly of any of A to A4, further comprising a pair of fasteners coupled to the compartment and configured to restrain first and second opposing ends of the folded first and second flaps against the compartment in the closed position.

A6. The enclosure assembly of A5, wherein the closure device is configured to unfold from the closed position to the open position without releasing the fasteners.

A7. The enclosure assembly of any of A to A6, wherein the folded first and second flaps are curved from a first end to a second end in the closed position, matching a curve of the second edge of the opening.

A8. The enclosure assembly of any of A to A7, further including an inflation mechanism extending into the compartment and connected to the uninflated airbag.

A9. The enclosure assembly of any of A to A8, wherein the first and second flaps are folded over three times in the closed position.

A10. The enclosure assembly of any of A to A9, wherein each of the first and second flaps includes a stiffened rim portion.

B. An airbag compartment enclosure assembly, comprising:

a compartment having an opening; and a closure device covering the opening, including a plurality of stacked folds of material having an effective stiffness;

wherein the overall stiffness of the plurality of stacked folds is selected such that the closure device opens in response to inflation of an airbag contained in the compartment.

B1. The enclosure assembly of B, wherein an interior volume of the compartment is selected such that the closure device opens in response to an inflation of the airbag by a predetermined volume.

B2. The enclosure assembly of either B or B1, wherein the stacked folds of material are made up of a first flap and a second flap folded over one another.

B3. The enclosure assembly of B2, wherein the first and second flaps are folded over three times.

B4. The enclosure assembly of any of B to B3, wherein the plurality of stacked folds of material is arched.

B5. The enclosure assembly of B4, wherein the arch of the plurality of stacked folds of material is inverted as the closure device opens.

B6. The enclosure assembly of any of B to B5, wherein the plurality of stacked folds is held in an arched position by a strap at each of a first and a second end, and the closure device is configured to open without releasing the straps.

B7. The enclosure assembly of any of B to B6, wherein the plurality of stacked folds of material includes a stiffener.

B8. The enclosure assembly of any of B to B7, wherein the compartment includes an anchor point configured for coupling to an airbag.

B9. The enclosure assembly of any of B to B8, further including a connector connecting an outer surface of the plurality of stacked folds to an exterior of the compartment, at each of a first and a second end of the plurality of stacked folds.

C. An airbag carrier assembly, comprising:

a pack including a compartment sized to contain a deflated airbag, the compartment including:

an opening, a closure device having an open position permitting inflation of an airbag contained in the compartment through the opening to a space outside the compartment, and a closed position covering the opening;

wherein the closure device transitions from the closed position to the open position by unfolding a flexible wall portion.

C1. The airbag carrier assembly of C, wherein the pack is part of a garment.

C2. The airbag carrier assembly of either C or C1, wherein the pack is a backpack having shoulder straps.

C3. The airbag carrier assembly of any of C to C2, wherein the flexible wall portion has a stiffened rim portion.

C4. The airbag carrier assembly of C3, wherein the rim portion is folded over at least twice in the closed position.

C5. The airbag carrier assembly of either C3 or C4, wherein the rim portion is curved in the closed position.

C6. The airbag carrier assembly of any of C to C5, wherein the closure device is configured to remain closed until a threshold level of force is exerted against the closure device from inside the compartment.

C7. The airbag carrier assembly of any of C to C6, further including a strap proximate each of a first end and a second end of the flexible wall portion, wherein the straps are fastened to the flexible wall portion and hold the first and second ends of the flexible wall portion against the pack in the closed position.

D. A method of deploying an airbag from inside a compartment, comprising:

unrolling a flexible wall portion of the compartment, and allowing an inflating airbag to at least partially exit the compartment through an opening defined by the flexible wall portion.

E. A method of containing an airbag inside a compartment, comprising:

deflating the airbag, positioning the entire airbag inside the compartment, the compartment having a closure device including a flexible wall portion defining an opening to the compartment, and rolling the flexible wall portion to transition the closure device to a closed position.

E1. The method of E, wherein the rolling step includes folding a rim portion of the flexible wall portion through at least two folds.

F. A method of preparing an airbag for emergency deployment in an avalanche, comprising:

providing a pack including a compartment and a mechanism for connecting the pack to a human body, the compartment having a closure device including flexible wall portions defining an opening configured to allow the airbag to inflate to a space at least partially outside the compartment, placing a deflated airbag inside the compartment, placing a compressed gas container inside the pack, connecting the compressed gas container to the airbag, and rolling the flexible wall portion to transition the closure device to a closed position.

F1. The method of F, wherein the rolling step includes folding a rim portion of the flexible wall portion through at least two folds.

Advantages, Features, and Benefits

The different examples of the airbag compartment enclosure assembly described herein provide several advantages over known solutions for storing and deploying airbags. For example, illustrative examples described herein allow consistent and reliable deployment of an airbag over time and after repeated usage.

Additionally, and among other benefits, illustrative examples described herein allow effective containment of an airbag prior to deployment, and also provide ample air flow and clear egress for the inflating airbag during deployment.

Additionally, and among other benefits, illustrative examples described herein allow deployment of an airbag without damage to the airbag compartment enclosure assembly.

Additionally, and among other benefits, illustrative examples described herein allow simple, intuitive re-closure after deployment of an airbag.

No known system or device can perform these functions, particularly under adverse weather conditions such as snow and ice. Thus, the illustrative examples described herein are particularly useful for avalanche safety airbags. However, not all examples described herein provide the same advantages or the same degree of advantage.

Conclusion

The disclosure set forth above may encompass multiple distinct examples with independent utility. Although each of these has been disclosed in its preferred form(s), the specific examples thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. An airbag compartment enclosure assembly, comprising:

a compartment containing an airbag that is uninflated; and a closure device fixed proximate an opening of the compartment, the closure device having an open position allowing expansion of the airbag through the opening and a closed position retaining the uninflated airbag, the closure device including:

a first panel extending from a first edge of the opening, and a second panel extending from a second, opposing edge of the opening;

wherein the first and second panels are folded over one another two or more times and held in an arched position by a strap at each of a first and a second end, in the closed position.

2. The airbag compartment enclosure assembly of claim 1, wherein the closure device is configured to unfold from the closed position to the open position when a pressure inside the compartment exceeds a selected threshold.

3. The airbag compartment enclosure assembly of claim 1, further comprising a backpack including the compartment.

4. The airbag compartment enclosure assembly of claim 1, wherein the straps are configured to restrain the first and second ends of the folded first and second flaps against the compartment in the closed position, and each strap includes a fastener.

5. The airbag compartment enclosure assembly of claim 4, wherein the closure device is configured to unfold from the closed position to the open position without releasing the fasteners.

6. The airbag compartment enclosure assembly of claim 1, wherein the folded first and second panels are curved from a first end to a second end in the closed position, matching a curve of the second edge of the opening.

7. An airbag compartment enclosure assembly, comprising:

a compartment having an opening; and a closure device covering the opening, including a plurality of stacked arched folds of material having a stiffness; and a connector connecting an outer surface of the plurality of stacked arched folds to an exterior of the compartment, at each of a first and a second end of the plurality of stacked folds;

wherein the stiffness of the plurality of stacked arched folds of material is selected such that the closure device opens in response to inflation of an airbag contained in the compartment.

8. The airbag compartment enclosure assembly of claim 7, wherein an interior volume of the compartment is selected such that the closure device opens in response to an inflation of the airbag by a predetermined volume.

9. The airbag compartment enclosure assembly of claim 7, wherein the plurality of stacked arched folds of material are made up of a first panel and a second panel folded over one another.

10. The airbag compartment enclosure assembly of claim 9, wherein the first and second panels are folded over three times.

11. The airbag compartment enclosure assembly of claim 7, wherein the plurality of stacked arched folds of material are held in an arched position by a strap at each of a first and a second end, and the closure device is configured to open without releasing the straps.

12. The airbag compartment enclosure assembly of claim 7, wherein the plurality of stacked arched folds of material includes a stiffener.

13. An airbag carrier assembly, comprising:

a pack including a compartment sized to contain a deflated airbag, the compartment including a closure device covering an opening, the closure device having an open position permitting inflation of an airbag contained in the compartment through the opening to a space outside the compartment, and a closed position covering the opening;

wherein the closure device transitions from the closed position to the open position by unfolding a flexible wall portion; and further including a strap proximate each of a first end and a second end of the flexible wall portion, wherein the straps are fastened to the flexible wall portion and hold a first and a second end of the flexible wall portion against the pack in the closed position, and the closure device is configured to transition from the closed position to the open position without releasing the straps.

14. The airbag carrier assembly of claim 13, wherein the pack is part of a garment.

15. The airbag carrier assembly of claim 13, wherein the pack is a backpack having shoulder straps.

16. The airbag carrier assembly of claim 13, wherein the flexible wall portion has a stiffened rim portion.

17. The airbag carrier assembly of claim 16, wherein the rim portion is curved in the closed position.

18. The airbag carrier assembly of claim 13, wherein the closure device is configured to remain closed until a threshold level of force is exerted against the closure device from inside the compartment.

* * * * *